United States Patent [19]

Lamborn et al.

[11] Patent Number: 4,771,884

[45] Date of Patent: Sep. 20, 1988

[54] CONTAINER FOR DISPENSING FLEXIBLE MATERIAL

[75] Inventors: John P. Lamborn; John P. Lamborn, Jr., both of Fresno; Lloyd R. Darnell, Prather, all of Calif.

[73] Assignee: J. P. Lamborn Co., Fresno, Calif.

[21] Appl. No.: 51,417

[22] Filed: May 19, 1987

[51] Int. Cl.[4] ..... B65D 85/14

[52] U.S. Cl. ..... 206/321; 206/446; 206/621; 206/806

[58] Field of Search ..... 206/321, 446, 525, 802, 206/806, 620, 621; 229/7 R, 17 R, 131; 221/45, 63; 414/411, 414

[56] References Cited

U.S. PATENT DOCUMENTS

| | | | |
|---|---|---|---|
| 2,015,653 | 10/1935 | Andrews | 229/7 R |
| 2,262,360 | 11/1941 | Gottlieb | 206/806 |
| 2,885,140 | 5/1959 | Guyer | 229/131 |
| 2,946,496 | 7/1960 | Stagmeier | 229/17 R |
| 3,165,234 | 1/1965 | Conklin et al. | 206/806 |
| 3,768,642 | 10/1973 | Hansen et al. | 206/321 |
| 4,478,354 | 10/1984 | Notheis | 221/63 |

FOREIGN PATENT DOCUMENTS

| | | | |
|---|---|---|---|
| 0107942 | 5/1984 | European Pat. Off. | 206/806 |

*Primary Examiner*—Jimmy G. Foster
*Attorney, Agent, or Firm*—Worrel & Worrel

[57] ABSTRACT

A container for dispensing flexible material having a housing adapted to receive the flexible material with an end portion in a dispensing position; and a control mechanism borne by the housing overlaying the dispensing position for resisting movement of the flexible material therethrough while permitting the flexible material to be pulled from the housing therethrough by the end portion for dispensing in selected lengths.

15 Claims, 3 Drawing Sheets

134
138
139
136
118
114
22
21
10
13
12
17
32
16
37
36
30
24
31
40
41
42
43
45
34

CONTAINER FOR DISPENSING FLEXIBLE MATERIAL

BACKGROUND OF THE INVENTION

1. Field of the Invention

The present invention relates to a container for dispensing flexible material and more particularly to such a container which is uniquely well suited to housing and dispensing flexible ducting in such a manner as to allow the operator to dispense selected lengths of ducting without releasing more than the desired length from the housing.

2. Description of the Prior Art

The storage, transport and dispensing of materials such as used in construction frequently presents very difficult problems. Materials employed at construction sites are commonly very bulky and must be used in quantities which require powered equipment to move them to the precise location desired for use. Conversely, even though the materials are difficult to move, frequently they are relatively fragile and thus loss due to damage is common. Still further, because such materials are difficult to handle, construction workers commonly leave unused materials at the construction site upon completion of the job rather than attempting to recover for subsequent use those materials which are otherwise entirely satisfactory. All of these factors contribute to waste at the job site and increase the cost of construction.

Flexible ducting used in virtually all construction presents these same difficulties. Flexible ducting is employed to handle the movement of air in the heating and cooling systems in virtually all habitable structures including homes, office buildings, factories and the like. Flexible ducting is, essentially, a very lightweight insulated conduit which is both longitudinally and transversely compressible. It can be produced in substantially continuous lengths, but for the sake of convenience is most commonly packaged in corrugated cardboard containers housing predetermined lengths of the ducting.

The ducting is commonly endwardly compressed within the container so that the maximum length of ducting can be housed in the smallest possible container. The compression of the ducting along its longitudinal axis is quite substantial and does not in any way damage the ducting. However, at the job site when such a container is opened for use, the ducting rapidly expands from the container to assume its normal length. Even if all of the length of duct is required for use, this phenomenon presents difficulties. With all of the ducting expelled from the container, it is subject to damage from puncturing, tearing or the like before it is installed. It may also be inconvenient to install when having to maneuver it through confined areas in its fully expanded configuration. It can, of course, at this time also become damaged.

Most commonly, not all of the ducting in one container will have to be employed at one time. While the ducting can easily be severed in the length or lengths desired, the unused portion becomes a problem. If left out of the container, it will likely become damaged or so impregnated with dust, paint, or other construction substances as to become unusable. The container in which it was originally housed may be available for use, but it is very difficult and certainly inconvenient to attempt to force the unused portion of ducting back within the container since this requires recompression of the ducting along its longitudinal axis. In this process the ducting characteristically will buckle and resist reinsertion under compression within the container. This process may itself damage the ducting so as to render it unusable. In other instances, the container may have been so torn apart in opening it that it can no longer house the ducting.

In any case, the result of such problems is that the ducting is simply abandoned at the job site thereby increasing the costs of construction.

Therefore, it has long been known that it would be desirable to have a container for dispensing flexible material having particular utility in the dispensing of flexible ducting and which permits the user to dispense from the container only the length of flexible ducting desired while retaining the remainder thereof within the housing for subsequent use; which preserves the unused portion of the ducting in a protected condition at the job site insulated from damage due to puncturing, tearing or the like or due to dust, paint or other construction materials; and which insures that waste due to abandonment of unused ducting at the job site is reduced to a minimum.

SUMMARY OF THE INVENTION

Therefore, it is an object of the present invention to provide an improved container for dispensing flexible material.

Another object is to provide such a container which has particular utility in the dispensing of flexible ducting used in construction.

Another object is to provide such a container which is operable to dispense only the length of flexible ducting required for use at any given time during construction while retaining the remainder of the flexible ducting housed therein in protected condition for subsequent use.

Another object is to provide such a container which retains the portion of the flexible ducting housed therein under compression in its original packaged condition.

Another object is to provide such a container which achieves its objectives with little or no additional cost over prior art containers for housing flexible ducting, which is easy to operate without prior instruction, and which does not present a risk of damage to the flexible ducting.

Another object is to provide such a container which operates cooperatively with the inherent properties of the flexible material to accomplish the objectives of the invention.

Another object is to provide such a container which can be constructed in a multitude of different forms and sizes while possessing the same operative advantages.

Another object is to provide such a container which reduces to a minimum the waste associated with the installation of flexible ducting at a job site by insuring that only the length of flexible ducting required for a particular installation is withdrawn from the container at any given time, which prevents damage and contamination of the unused portion of the flexible ducting and which remains in a condition appropriate for transport and storage at all times so as to minimize the chance that it will be abandoned at the job site.

Further objects and advantages are to provide improved elements and arrangements thereof in an apparatus for the purposes described which is dependable, economical, durable and fully effective in accomplishing its intended purposes.

These and other objects and advantages are achieved in the container for dispensing flexible material of the present invention wherein a housing is adapted to receive the flexible material with an end portion in a dispensing position and a control mechanism is borne by the housing overlaying the dispensing position and imparting resistance to the flexible material while permitting the flexible material to be pulled from the housing by the end portion for dispensing in selected lengths.

DESCRIPTION OF THE PREFERRED EMBODIMENTS

FIRST FORM

Figure 1:
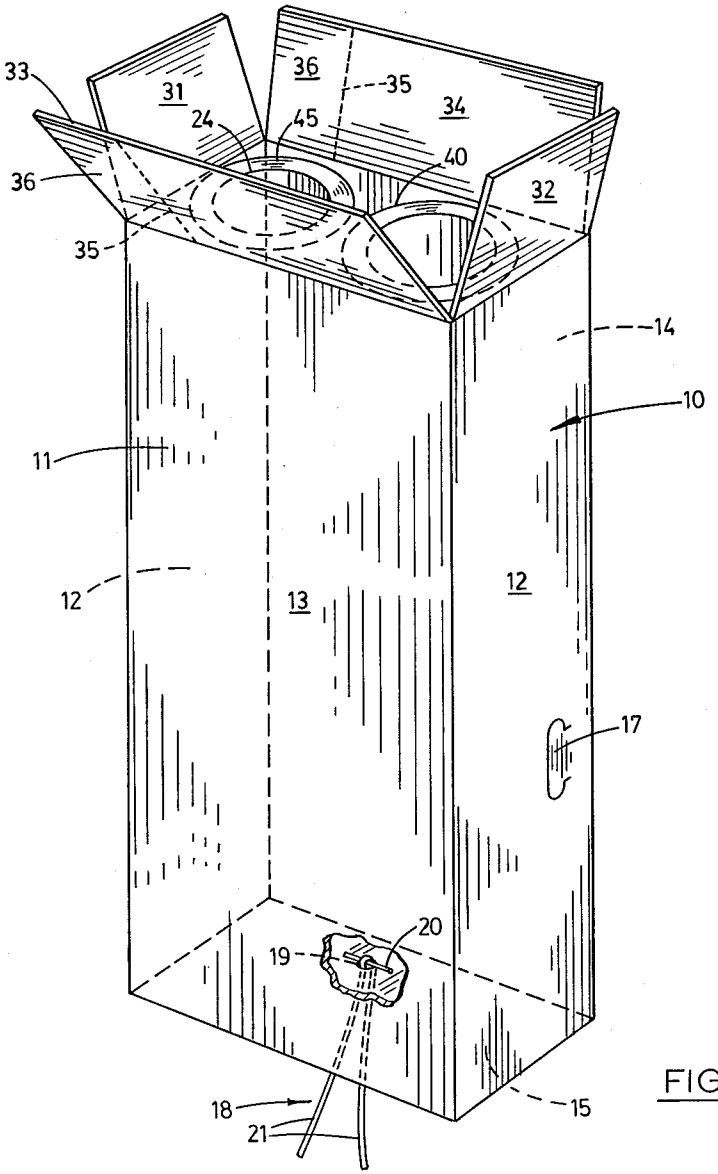
FIG. 1 is a perspective view of the container of the first form of the present invention showing, for purposes of illustration, flexible ducting in phantom lines housed therein, with the end flaps of the container in opened attitudes and with a portion of the container broken out to reveal the point of attachment to the container of the securing means of the container.

Referring more particularly to the drawings, the container of the first form of the present invention is generally indicated by the numeral 10 in FIG. 1. The container has a housing or carton 11 preferably, although not necessarily, constructed of corrugated cardboard. The carton has a pair of substantially parallel side walls 12 joined by front and back walls 13 and 14 respectively to form the box-like carton. The carton has a lower end wall 15 joining the side walls, front wall and back wall and an opposite upper end wall 16. The upper end wall is composed of flaps hereinafter to be described which are shown in FIG. 1 in opened attitudes and in FIG. 2 in closed attitudes.

Figures 3, 4, 9:
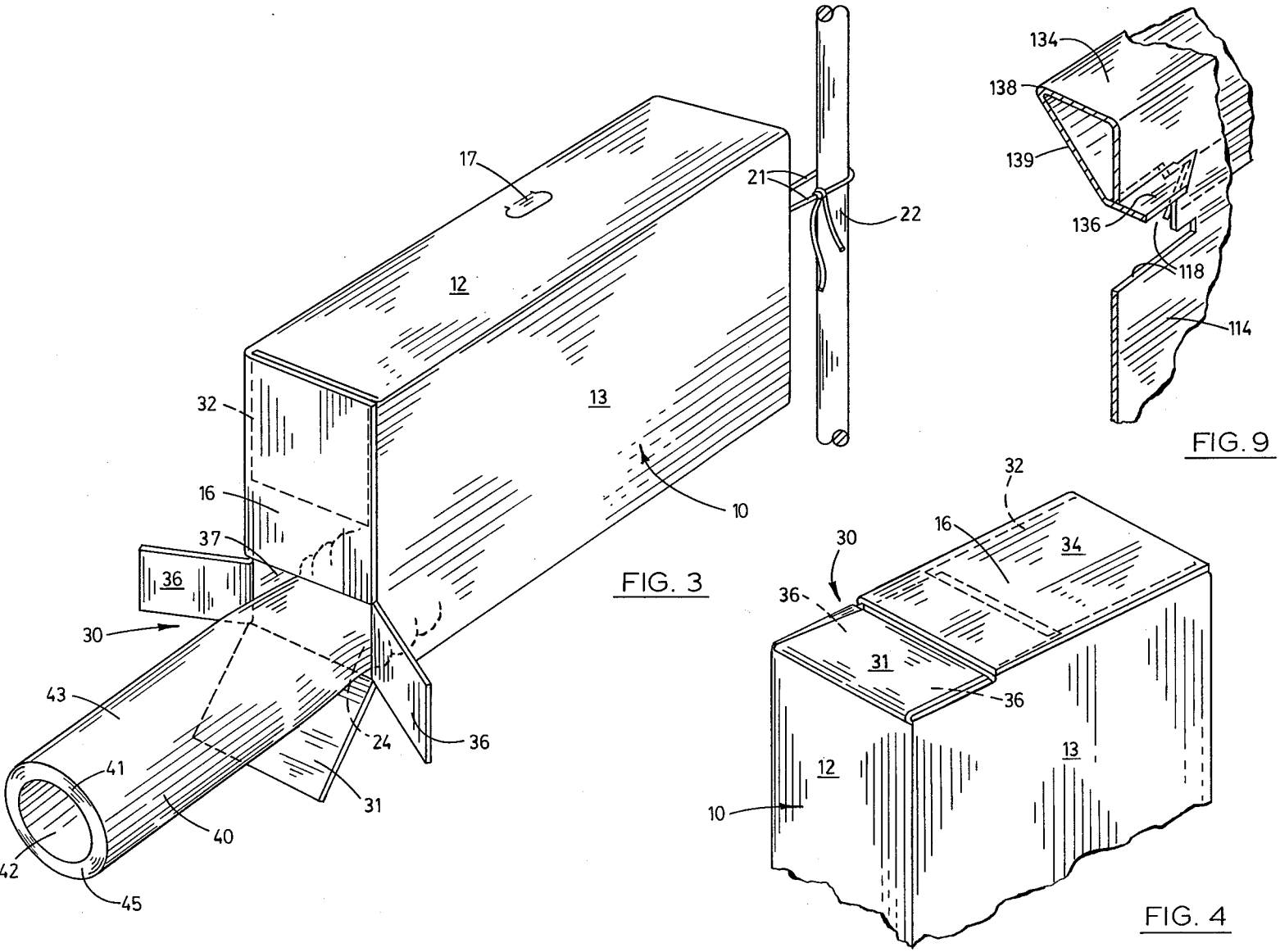
FIG. 3 is a perspective view of the container of FIG. 1 shown in a typical operative environment.
FIG. 4 is a fragmentary perspective view of the container of FIG. 1 with the end flaps thereof disposed in closed attitude.
FIG. 9 is a somewhat further enlarged, fragmentary, sectional, perspective view of a flap of the container of FIG. 5 folded into a configuration forming a shoulder operable during dispensing.

One of the side walls 12 has a hand opening 17 through which a person's hand can be extended to grasp the side wall for purposes of carrying or maneuvering the carton. A securing means 18 is mounted on the lower end wall 15. The securing means includes a perforation 19 in the lower end wall. A rod 20 is disposed within the carton and lines 21 are tied on the rod and extended through the perforation externally of the carton. The lines 21 are adapted to be secured, where desired, as shown in FIG. 3 on any available structure such as the bar 22 at a construction site for purposes of holding the carton stationary while removing the contents therefrom.

The carton 11 encloses an internal chamber 23 which, for purposes of illustrative convenience, will be understood to have a dispensing position 24 hereinafter to be discussed in greater detail.

The upper end wall 16 of the carton 11, as previously noted, is composed of flaps. The flaps as shown in the drawings and hereinafter described compose a control means or mechanism 30 for the carton 11. The control mechanism includes a first end flap 31 integral with one of the side walls 12 and an opposite second end flap 32 integral with the other of the side walls 12. The control mechanism further includes a lower cover flap 33 borne by and integral with the front wall 13 and an opposite upper cover flap 34 borne by and integral with the back wall 14. The lower and upper cover flaps each have perforations 35 adjacent to the first end flap 31, as shown in FIGS. 1 and 2, to define dispensing flaps 36.

The upper end wall 16 of the carton is formed by the first and second end flaps 31 and 32 being folded toward each other so as to overlay the internal chamber 23, the lower cover flap 33 folded over the first and second end flaps and the upper cover flap 34 folded the opposite direction to overlay the lower cover flap. The upper end wall, so formed, is retained in this configuration to seal the carton with the product in it at the plant by any suitable means including staples, adhesive tape or the like. In use, as will hereinafter be described, the lower and upper cover flaps are torn along the perforations 35 to form the dispensing flaps 36 and folded backwardly. The first end flap 31 is then slipped from beneath the remainder of the lower and upper cover flaps and folded backwardly thus forming a dispensing opening 37. As can best be visualized in FIG. 3, the dispensing opening so formed is defined by the first end flap 31, the dispensing flaps 36 and the edges of the lower and upper cover flaps 33 and 34 respectively formed by tearing along the perforations 35.

The container 10 of the present invention is adaptable to dispensing a variety of types of flexible materials. It is particularly well suited to dispensing flexible ducting 40 which is compressible both transversely and longitudinally. For purposes of understanding its typical basic structure, it will be understood that it consists of tubular insulating material 41 having an inner liner 42 and an outer liner 43. Enclosed in the flexible ducting to give it shape is a helical spring wire, not shown, which forms a helical rib 44 about the flexible ducting. The flexible ducting can be manufactured in any length and diameter. It is the practice in the industry to manufacture the ducting in standard lengths and diameters and to package the ducting in a longitudinally compressed condition.

Figure 2:
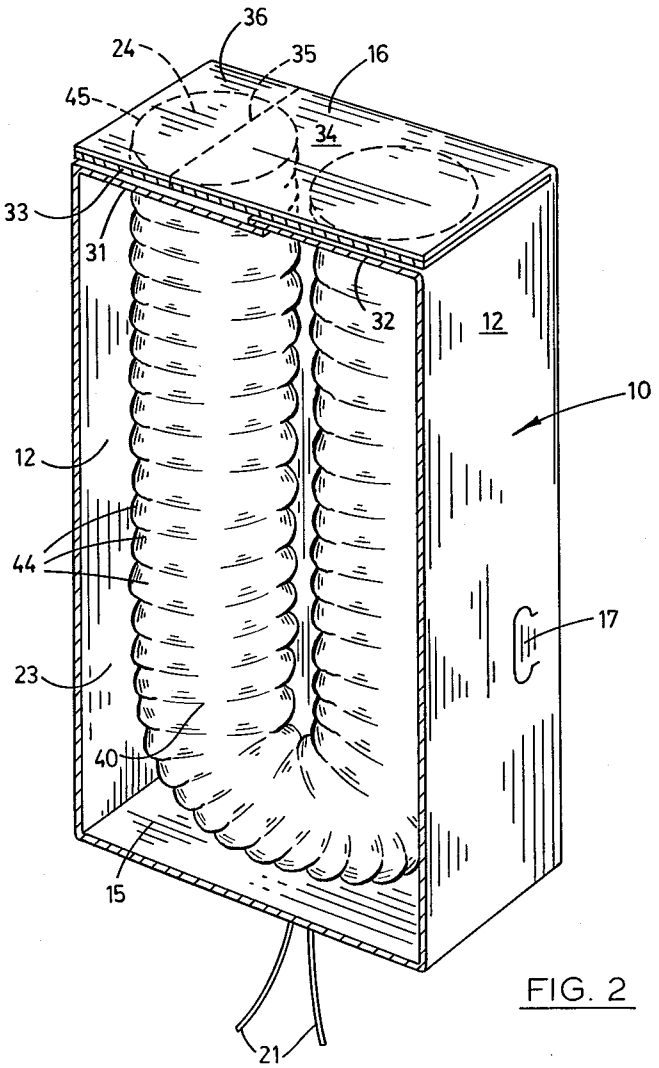
FIG. 2 is a longitudinal section of the container of FIG. 1 shown in perspective view with a length of flexible ducting housed therein.

As shown in FIGS. 1, 2 and 3, the flexible ducting 40 is disposed in the container 10 in a U-shaped configuration, longitudinally compressed so as to fit the maximum length of the ducting in the container and with an end portion 45 in the dispensing position 24. The distance across the dispensing opening 37 between the first end flap 31 and the remainder of the lower and upper cover flaps 33 and 34 at the perforations 35 is less than the diameter of the flexible ducting.

SECOND FORM

The second form of the container of the present invention is generally indicated by the numeral 110 and is shown in FIGS. 5 through 9. As previously noted, the container of the present invention is adaptable to a wide variety of specific embodiments. The second form of the container is an embodiment adapted for use in dispensing a twenty-five foot length of flexible ducting longitudinally compressed to fit within the container.

The container 110 has a housing or carton 111 having side walls 112, a front wall 113 and a back wall 114. The carton has a lower end wall 115, an opposite upper end wall 116 and a hand opening 117. The carton 111, of course, can be fitted with a securing means such as that of the carton 11 for the purposes described but this is not shown in the drawings. The front wall and back wall have openings or slots 118 therein in predetermined corresponding positions adjacent to the upper end wall 116. The carton encloses an internal chamber 123 which has a dispensing position 124 just inwardly of the upper end wall 116.

Figure 6:
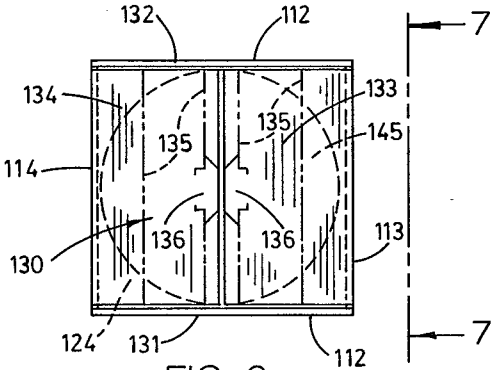
FIG. 6 is a top plan view of the container of FIG. 5 showing the outer end flaps thereof disposed in opened attitudes.
Figure 7:
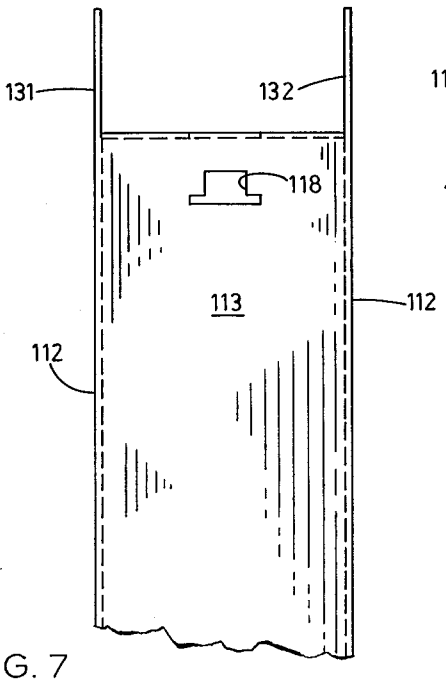
FIG. 7 is a fragmentary side elevation of the container of FIG. 5 taken from a position indicated by line 7—7 in FIG. 6.

The container 110 has a control means or mechanism 130 which is incorporated in the upper end wall 116 of the carton 111. Thus, the upper end wall is composed of a first end flap 131 borne by and integral with the side wall 112 on the left as viewed in FIG. 7. A second end flap 132 is borne by and integral with the side wall 112 on the right as viewed in FIG. 7. A front flap 133 is mounted on the front wall 113 of the carton 111 and a rear flap 134 is mounted on the back wall 114. Both the front and rear flaps are dimensioned to overlay the dispensing position 124, as shown in FIG. 6, in flattened condition when the carton is sealed. The front and rear flaps 133 and 134 have fold or score lines 135 which permit the front and rear flaps to be folded into the configurations shown in FIGS. 8 and 9. The front and rear flaps each are severed as shown in FIG. 6 so that when each is folded along the score lines 135, projections 136 are formed which are engageable in the slots 118 of their respective front and back walls 113 and 114 releasably to retain the front and rear flaps in the configurations shown in FIG. 8.

Figure 8:
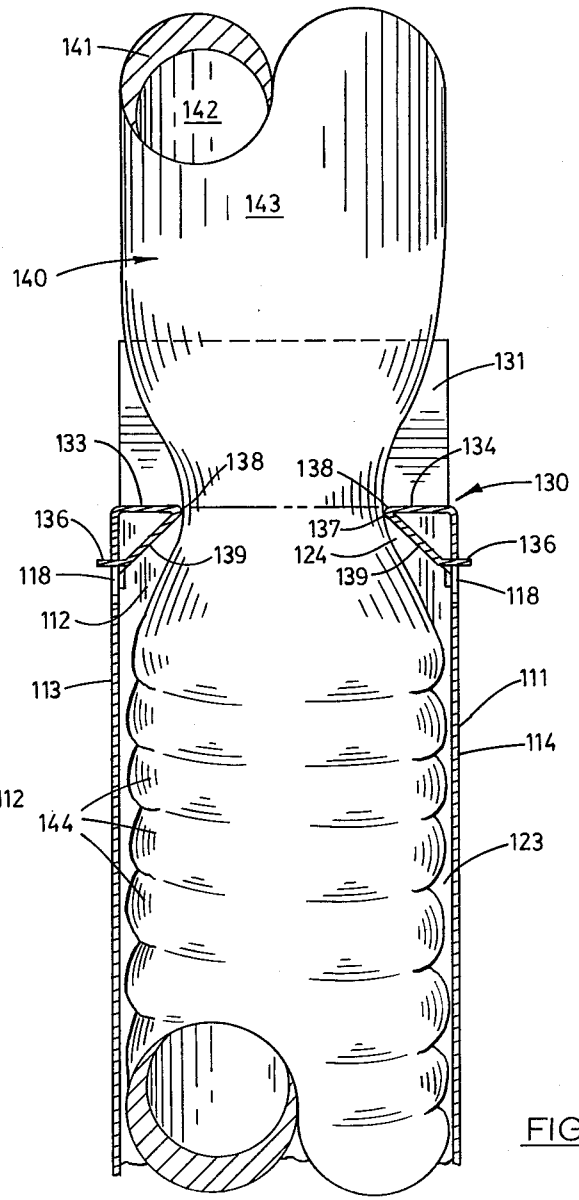
FIG. 8 is a somewhat enlarged, longitudinal, vertical section taken from a position indicated by line 8—8 in FIG. 5 and fragmentarily showing a length of flexible ducting therein in the process of being dispensed from the container.

When the front flap 133 and rear flap 134 are disposed in the configurations shown in FIG. 8, they define a dispensing opening 137 therebetween. Both the front and rear flaps are, in the folded configurations, substantially triangular in cross section having shoulders 138 bounding and defining the dispensing opening and oblique surfaces 139 facing substantially inwardly of the internal chamber 123.

The container 110 is adapted to house for transport and storage a length of flexible ducting 140. The flexible ducting is constructed of tubular insulating material 141 having an inner liner 142 and an outer liner 143. An internal helical spring wire, not shown, imparts a helical rib 144 to the flexible ducting. The flexible ducting has an end portion 145, visible in phantom lines in FIG. 6, which when the flexible ducting is sealed within the carton 111 is in the dispensing position 124 engaging the front and rear flaps 133 and 134 as they compose part of the upper end wall 116. As previously noted, in the sealed configuration the flexible ducting 140 is of a fifty foot length when not compressed longitudinally thereof. However, when sealed within the carton 111, the flexible ducting is compressed to a substantial degree along its longitudinal axis and is held in this condition by the sealed lower and upper end walls 115 and 116 respectively which are individually engaged by the opposite ends of the flexible ducting. The flexible ducting is thus held in position in a straight configuration rather than the U-shaped configuration in the case of the container 10 shown in FIG. 2.

OPERATION

The operation of the described embodiments of the present invention is believed to be readily apparent and is briefly summarized at this point. The containers 10 and 110 are operated in similar manners. In both instances the flexible ducting 40 and 140 is longitudinally compressed during packaging so that the ducting is retained in the compressed condition by engagement with the upper end wall 16 and 116, respectively. In the case of the flexible ducting 40, the ducting is placed under such compression in the U-shaped configuration shown in FIG. 2 so that both ends engage the upper end wall 16. In the case of container 110, the flexible ducting is captured in the compressed condition between the lower end wall 115 and the upper end wall 116. In both cases, the upper end wall is sealed and the containers are transported and stored in this condition. Container 10 is shown in a sectional view in this sealed condition in FIG. 2. Container 110 is shown in a perspective view in this sealed condition in FIG. 5.

When it becomes time to dispense flexible ducting from the containers 10 and 110, the upper end walls 16 and 116, respectively, are opened as hereinafter described. In the case of container 10, the dispensing flaps 36 are torn along their respective perforations 35 and opened outwardly and the first end flap 31 is slipped from beneath the remainder of the lower and upper cover flaps 33 and 34 respectively. This condition is shown in FIG. 3. With respect to the container 110, the first and second end flaps 131 and 132 respectively are opened outwardly to expose the front flap 133 and the rear flap 134 as shown in FIG. 6. The front and rear flaps are then folded along the fold lines 135 and the projections 136 individually inserted and captured in the slots 118 of the front and back walls 113 and 114 respectively. The front and rear flaps are thus retained in the configuration shown in FIG. 8.

Prior to dispensing the flexible ducting 40 from the container 10, the operator can secure the carton 11 on a suitable stationary object such as the bar 22 at the construction site using the securing means 18.

The operator thereafter simply grasps the end portion 45 or 145 of the flexible ducting 40 or 140 and pulls it through the dispensing opening 37 or 137 until the desired length of flexible ducting has been pulled from the carton 11 or 111. The operator then severs the desired length of flexible ducting using a knife, shears or the like. The transverse compression of the flexible ducting by the control mechanism 30 or 130 prevents more than the desired length of flexible ducting from being paid out, permits the ducting pulled from the carton to be stretched to its full length for accuracy in cutting and retains the longitudinally compressed remainder of the flexible ducting within the carton. The operator can simply leave the newly formed end portion in the opening or push it back into the dispensing position 24 or 124 within the internal chamber 23 or 123. When the operator is ready for a new length of flexible ducting, he simply repeats the process.

The action of the control mechanisms 30 and 130 is such that the transverse compression imparted to the flexible ducting is sufficient to hold the ducting in position unless pulled outwardly or pushed inwardly by the operator. The compression is not so great as to cause any damage whatsoever to the ducting.

In the preferred forms of the invention the resistance is provided by transverse compression of the ducting as noted. This is achieved in both preferred forms of the invention by the opening 37 and 137 being smaller in at least one dimension than the diameter of the flexible ducting. However, the invention also includes the application of such resistance by other suitable means as may be appropriate and permitted by the extent of the longitudinal compression of the flexible ducting. For example, various means for imparting frictional resistance at the dispensing openings 37 and 137 may also be employed.

If the operator finishes with the installation of flexible ducting at the job site before using all of the ducting within the container 10 or 110, he simply pushes the newly formed end portion back into the internal chamber 23 or 123. In the case of container 10, the dispensing flaps 36 are then folded over the dispensing opening and the first end flap 31 folded over the dispensing flaps and slipped under the lower and upper cover flaps 33 and 34 respectively, as shown in FIG. 4. The container is thus sealed and can be transported and stored for subsequent use without further effort.

Figure 5:
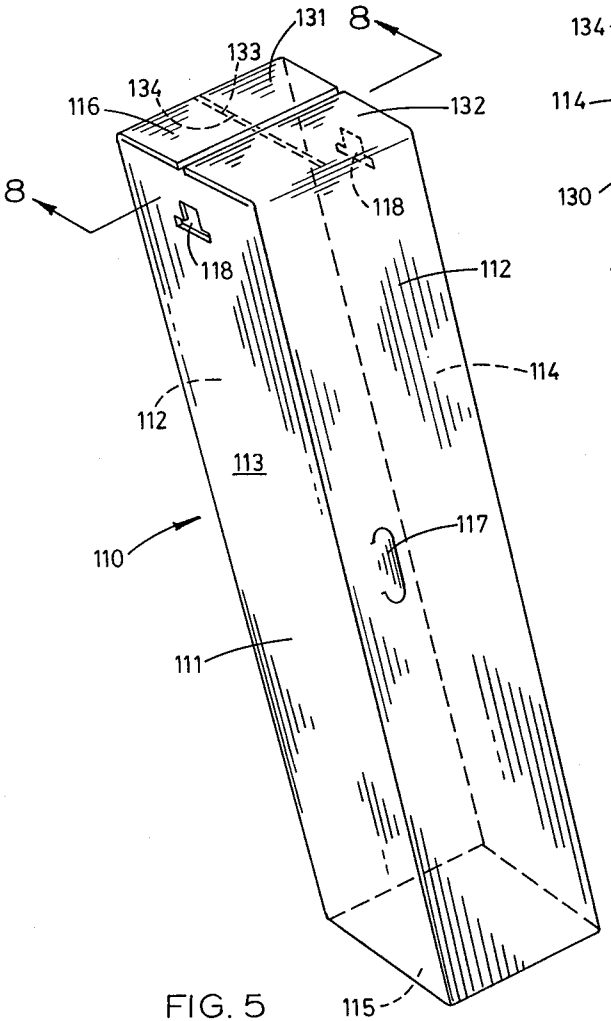
FIG. 5 is a perspective view of the container of the second form of the present invention.

As to the container 110, the projections 136 are disengaged from the slots 118 and the front and rear flaps unfolded and placed in flattened condition over the end portion 145 of the flexible ducting. The first and second end flaps 131 and 132 are then folded into covering relation as shown in FIG. 5 and tape, staples or the like employed to hold them in place. The container 110 can subsequently be transported and stored as desired.

Therefore, the container for dispensing flexible material of the present invention has particular utility in the dispensing of flexible ducting and permits the user to dispense from the container only the length of flexible ducting desired while retaining the remainder thereof within the housing for subsequent use; preserves the unused portion of the ducting in a protected condition at the job site insulated from damage due to puncture, tearing or the like or due to dust, paint or other construction materials; and insures that waste due to abandonment of unused ducting at the job site is reduced to a minimum.

Although the invention has been herein shown and described in what are conceived to be the most practical and preferred embodiments, it is recognized that departures may be made therefrom within the scope of the invention which is not to be limited to the illustrative details disclosed.

Having described our invention, what we claim as new and desire to secure by Letters Patent is:

1. In combination with a product to be dispensed which is longitudinally compressible and has opposite end portions, a container for dispensing said product, said container comprising a receptacle having said product therewithin and having portions engageable with said product therewithin to maintain the product under compression longitudinally thereof; and means borne by the receptacle for defining a dispensing opening and having a portion operable laterally to engage said product to resist movement of an end portion of the product through the opening to control dispensing of the product from the receptacle through the opening.

2. The combination of claim 1 wherein said opening in one dimension is not larger than a transverse dimension of the product.

3. The combination of claim 2 wherein said defining means includes edge portions bounding said opening and disposed for frictional engagement with the product.

4. The combination of claim 1 wherein the opening in one dimension is smaller than a transverse dimension of the product for engagement by the defining means therewith to provide resistance to passage of the product through said opening.

5. In combination with flexible ducting, a container for dispensing said ducting the container comprising a substantially rigid housing defining an internal chamber internally retaining said ducting under compression longitudinally of the ducting with an end portion of the ducting disposed in the chamber in a predetermined dispensing position; and control means borne by the housing overlaying said dispensing position and positionable in a dispensing attitude defining an opening dimensioned to permit the end portion to be pulled from the internal chamber through the opening and to impart compression transversely of the end portion of the ducting to resist movement of the end portion through the opening thereby retaining the ducting under compression longitudinally thereof whereby said ducting can be dispensed from the housing by pulling the end portion through the opening to expose the length of ducting desired.

6. The combination of claim 5 wherein said control means is an end wall of the housing having a flap movable from the end wall to define said opening having a dimension smaller than the transverse dimension of the ducting.

7. (Amended) The combination of claim 5 wherein said end wall is composed of overlaying wall portions perforated along predetermined courses permitting flaps thereof to be torn along said courses and folded outwardly to form said opening.

8. The combination of claim 5 wherein the housing is dimensioned to receive the ducting therewithin in a substantially U-shaped configuration with said end portion thereof in the dispensing position.

9. The combination of claim 5 wherein said control means is an end wall of the housing composed of a flap foldable along predetermined courses to permit the flap to be folded to form a shoulder spaced from the remainder of the end wall to define said opening.

10. The combination of claim 9 wherein the control means has a pair of said flaps foldable along predetermined courses individually to form a pair of juxtaposed shoulders spaced from each other to define said opening.

11. The combination of claim 10 wherein the housing has slots therein in predetermined positions adjacent to the end wall and the flaps have projections individually engageable with the slots releasably to retain the flaps in folded configurations forming said shoulders.

12. The combination of claim 11 wherein said courses along which each of said flaps is foldable are arranged so that when folded the flap forms a substantially triangular configuration in cross section with an oblique surface facing substantially inwardly of the internal chamber.

13. The combination of claim 5 wherein the container mounts means remote from said control means for securing the housing on a stationary object to resist movement of the housing when the end portion of the ducting is pulled from the internal chamber through said opening.

14. In combination with an elongated product to be dispensed which is longitudinally compressible and has opposite end portions, a container operable in one configuration to store said product therewithin and in another configuration selectively to dispense said product from the container, the container comprising a substantially rigid housing internally retaining said product under compression longitudinally of the product; and control means borne by the housing in proximity to a predetermined dispensing position and said control means being positionable in a dispensing attitude defining an opening in said dispensing position dimensioned to permit an end portion of the product to be pulled from the housing through the opening and to impart resistance transversely of said end portion of the product to resist movement of the end portion through the opening thereby retaining the product under compression longitudinally thereof to permit dispensing of only the length of said product desired.

15. The combination of claim 14 wherein the product is transversely compressible and said opening of the control means of the container in said dispensing attitude is dimensioned to impart compression transversely of said end portion of the product to resist movement of the end portion through the opening.

* * * * *

UNITED STATES PATENT AND TRADEMARK OFFICE

CERTIFICATE OF CORRECTION

PATENT NO. : 4,771,884

DATED : September 20, 1988

INVENTOR(S) : John P. Lamborn, John P. Lamborn, Jr., and Lloyd R. Darnell

It is certified that error appears in the above-identified patent and that said Letters Patent is hereby corrected as shown below:

Column 8, line 16, insert a comma between "ducting" and "the".

Column 8, line 39, delete "(Amended)".

Signed and Sealed this

Seventeenth Day of January, 1989

*Attest:*

DONALD J. QUIGG

*Attesting Officer*

*Commissioner of Patents and Trademarks*